US007762641B2

(12) United States Patent
Kim et al.

(10) Patent No.: US 7,762,641 B2
(45) Date of Patent: Jul. 27, 2010

(54) INK INJECTION METHOD AND APPARATUS

(75) Inventors: Hyun-Sik Kim, Daejeon (KR); Duk-Sik Ha, Cheongju-si (KR)

(73) Assignee: LG Chem, Ltd., Seoul (KR)

( * ) Notice: Subject to any disclaimer, the term of this patent is extended or adjusted under 35 U.S.C. 154(b) by 885 days.

(21) Appl. No.: 11/640,976

(22) Filed: Dec. 19, 2006

(65) Prior Publication Data

US 2007/0139466 A1 Jun. 21, 2007

(30) Foreign Application Priority Data

Dec. 21, 2005 (KR) ..... 10-2005-0127128

(51) Int. Cl.
*B41J 29/38* (2006.01)
*B41J 23/00* (2006.01)

(52) U.S. Cl. ..... 347/14; 347/37

(58) Field of Classification Search ..... 347/12, 347/14, 37, 39, 19, 41; 358/1.5; 400/279, 400/283

See application file for complete search history.

(56) References Cited

U.S. PATENT DOCUMENTS 7,219,977 B2 * 5/2007 Mitsuzawa ..... 347/43
7,275,806 B2 * 10/2007 Matsuzawa et al. ..... 347/43

* cited by examiner

*Primary Examiner*—Shih-wen Hsieh
(74) *Attorney, Agent, or Firm*—McKenna Long & Aldridge LLP

(57) ABSTRACT

An ink injection method includes the steps of: storing vibration region information of a stage to which a head for injecting ink is mounted; changing coordinates of the stage by deducting the coordinates as much as the vibration region in a direction opposite to a pattern printing direction on the basis of coordinates at which pattern printing starts; moving the stage in the pattern printing direction after the stage is moved to the changed coordinates; deducting the changed coordinates from current coordinates of the stage to calculate a moving distance of the moving stage; and controlling the head to inject ink in correspondence to the pattern in case the moving distance of the stage is corresponding to the vibration region. This method prevents erroneous pattern printing due to initial vibration caused by movement of the stage when ink is injected for printing the pattern.

7 Claims, 5 Drawing Sheets

INK INJECTION METHOD AND APPARATUS

This application claims priority to Korean Application 10-2005-0127128 filed on Dec. 21, 2005, which is incorporated by reference, as if fully set forth herein.

BACKGROUND OF THE INVENTION

1. Field of the Invention

The present invention relates to a printing device using an inkjet head, and more particularly to an ink injection method and apparatus that prevents erroneous pattern printing caused by vibration of a stage of the inkjet head.

2. Description of the Related Art

An inkjet head requiring high-accuracy positioning employs a linear motor as a driving source of its stage, and a base for placing the stage thereon is installed on a bottom using an anti-vibration means for eliminating vibration from the bottom.

Accordingly the base is placed in an unstable form, so, when the stage is operated, the stage is vibrated due to a repulsive force occurring in a direction opposite to the driving direction.

This vibration shakes the inkjet head installed to the stage, so patterns injected by the inkjet head are also shaken corresponding to the vibration.

Seeing it in more detail with reference to FIG. 1, a vibration caused by movement of a stage is generally generated at an initial ink injection, so a portion printed by initially injected ink is generally shaken due to the vibration.

As a technique for solving this problem, there is Korean Patent Application No. 10-2004-0059486, entitled "Repulsive force processing system for a stage device".

This document discloses a repulsive force processing system including a propulsive force generating means for generating a propulsive force to offset a repulsive force applied to a base, and a control means for controlling a gain adjustment means for adjusting a gain of the propulsive force generating means.

However, though a propulsive force is generated to remove vibrations according to the above technique, there is a limit in completely eliminating the vibrations generated in an initial process.

Referring to FIG. 2 showing a vibrating status of the stage, the stage is abruptly vibrated in an initial moving process of the stage, and then these vibrations are reduced as time goes.

However, the conventional repulsive processing system requires a predetermined time to detect movement of the stage and generate a propulsive force, so it cannot rapidly remove the vibrations abruptly generated in an initial moving process of the stage.

Thus, there is an urgent need for a technique capable of solving the conventional problem that printed patterns are spoiled due to vibrations abruptly generated in an initial moving process of the stage.

SUMMARY OF THE INVENTION

The present invention is designed to solve the problems of the prior art, and therefore it is an object of the present invention to provide an ink injection method and apparatus for detecting an initial vibration region of a stage to which a head for injecting ink is mounted, changing stage coordinates in a backward position before the initial vibration region when printing a pattern, and then starting ink injection for the pattern printing if the stage moves as much as the vibration region so that the pattern is not printed erroneously due to initial vibrations generated by movement of the stage.

In order to accomplish the above object, the present invention provides an ink injection method, including: (a) storing vibration region information of a stage to which a head for injecting ink is mounted; (b) changing coordinates of the stage by deducting the coordinates as much as the vibration region in a direction opposite to a pattern printing direction on the basis of coordinates at which pattern printing starts; (c) moving the stage in the pattern printing direction after the stage is moved to the changed coordinates; (d) deducting the changed coordinates from current coordinates of the stage to calculate a moving distance of the moving stage; and (e) controlling the head to inject ink in correspondence to the pattern in case the moving distance of the stage is corresponding to the vibration region.

Preferably, the step (a) includes: storing initial coordinates of the stage; sensing vibration of the stage while moving the stage in a predetermined direction; storing current coordinates of the stage in case vibration of the stage is within a predetermined range; and calculating the vibration region of the stage by deducting the initial coordinates from the current coordinates. Selectively, the step (a) may further include the step of adding a predetermined value to the vibration region of the stage and setting the result value as a final vibration region.

The ink injection method according to the present invention may further include the step of sensing vibration of the stage while ink is injected in correspondence to the pattern; and intercepting the ink injection in case the vibration of the stage exceeds a predetermined limit.

In another aspect of the present invention, there is also provided an ink injection apparatus, including: a head for injecting ink to print a pattern; a head controller for controlling the head; a stage to which the head is mounted; a stage driver for driving the stage; a memory for storing vibration region information of the stage; and a controller executing: deducting coordinates of the stage in a direction opposite to a pattern printing direction on the basis of initial coordinates at which pattern printing starts; controlling the stage driver to move the stage to the changed coordinates and then to move the stage in the pattern printing direction; calculating a moving distance by deducting current coordinates of the stage from the changed coordinates; and controlling the head controller to inject ink in correspondence to the pattern in case the moving distance of the stage is corresponding to the vibration region.

The ink injection method and apparatus according to the present invention may detect an initial vibration region of a stage to which a head for injecting ink is mounted, change stage coordinates in a backward position before the initial vibration region when printing a pattern, and then start ink injection for the pattern printing if the stage moves as much as the vibration region so that the pattern is not printed erroneously due to initial vibrations generated by movement of the stage.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 3:
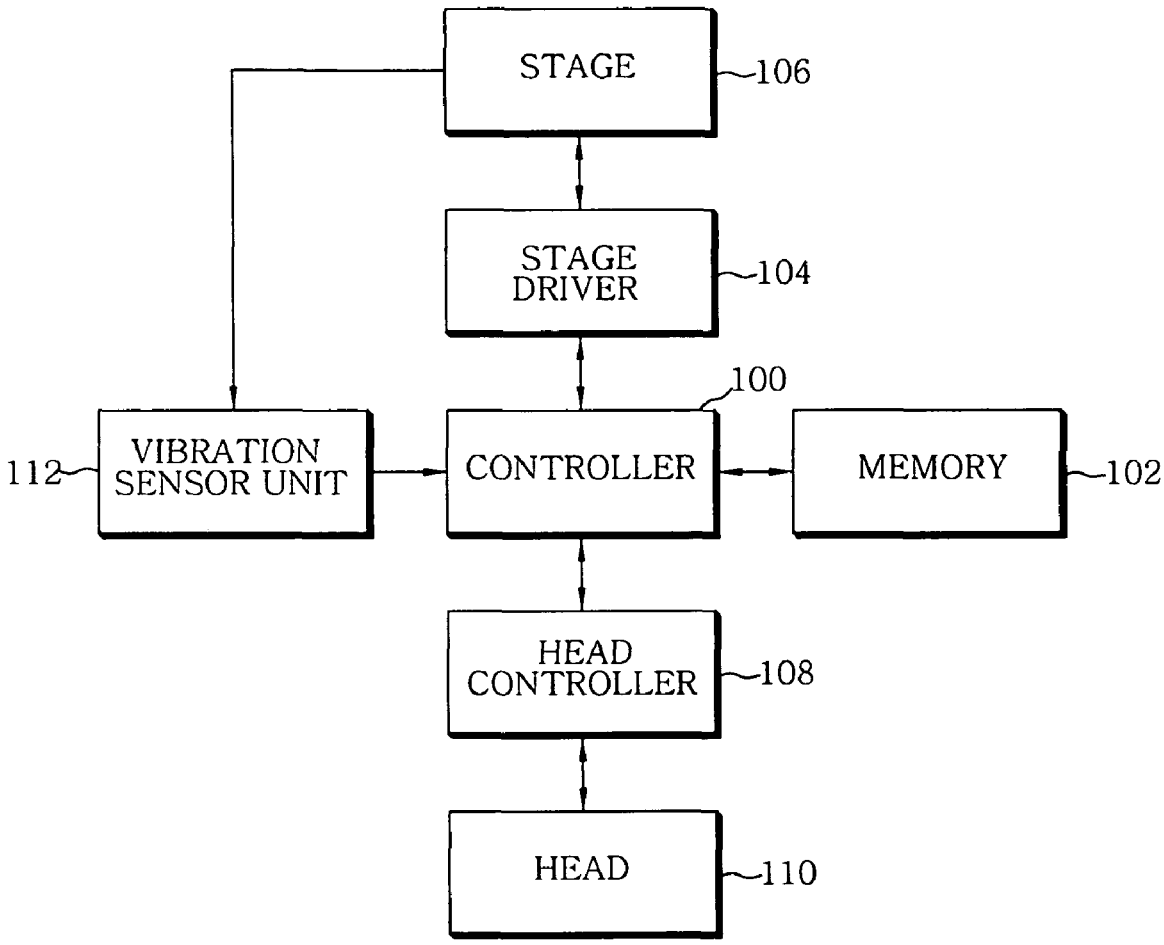
FIG. 3 is a block diagram showing an ink injection apparatus according to a preferred embodiment of the present invention.

First, an ink injection apparatus according to a preferred embodiment of the present invention will be explained in detail with reference to FIG. 3.

A controller 100 controls the overall operation of the ink injection apparatus. According to the preferred embodiment of the present invention, the controller 100 also detects an initial vibration region caused by movement of a stage, changes stage coordinates into a backward position before the initial vibration range when printing a pattern, and controls a stage driver 104 and a head controller 108 to start ink injection for the pattern printing when the stage 106 moves as much as the vibration region.

A memory 102 stores various kinds of information such as a processing program of the controller 10, and particularly it stores information related to the initial vibration region according to the preferred embodiment of the present invention.

The stage driver 104 moves the stage 106 under the control of the controller 100 using a linear motor or the like. In particular, the stage driver 104 drives the stage 106 at a velocity of 100 mm/sec and an accelerating time of 300 ms.

The head controller 108 operates a head 110 under the control of the controller 100, and conducts ink injection. The head 110 is installed to the stage 106, and injects ink in correspondence to a pattern with moving, thereby conducting the pattern printing.

Figure 1:
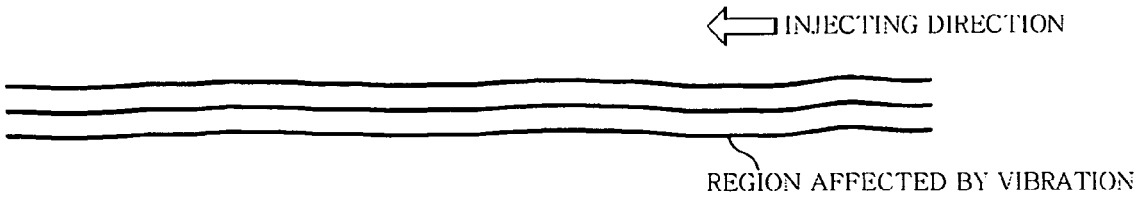
FIG. 1 (PRIOR ART)
FIG. 1 is a schematic view showing an example of ink injection according to the vibration of a stage.
Figure 2:
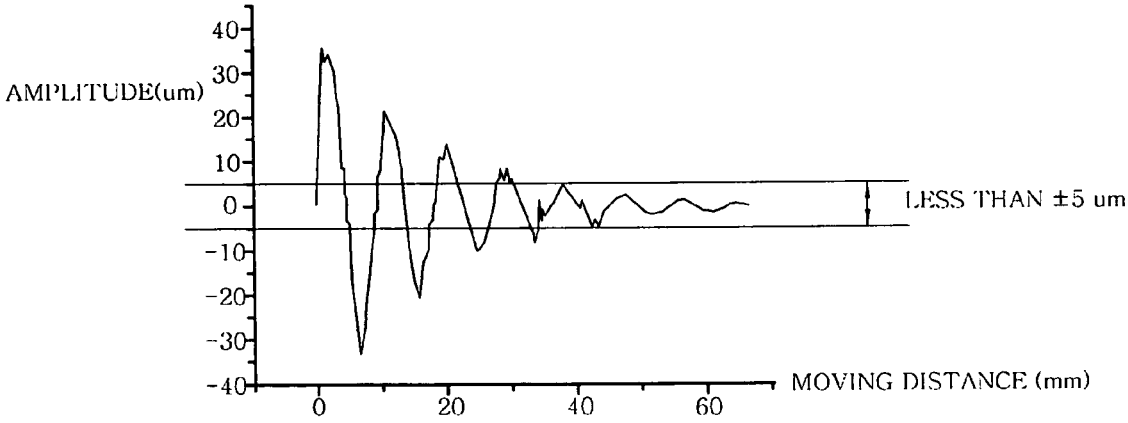
FIG. 2 (PRIOR ART)
FIG. 2 is a graph showing a vibration state of the stage.

A vibration sensor unit 112 is composed of at least one vibration sensor installed to the stage 106. The vibration sensor unit 112 senses vibration of the stage 106 moving at a velocity of 100 mm/sec and an accelerating time of 300 ms, and then provides it to the controller 100. Here, the vibration of the stage 106 moving at a velocity of 100 mm/sec and an accelerating time of 300 ms shows an amplitude of ±35 um in an initial process, but the amplitude is reduced to a level of ±5 um after the stage 106 moves 38 mm, as shown in FIG. 2. In this case, in the present invention, a moving distance of 38 mm may be set as the initial vibration region. The vibration sensor unit 112 may employ various sensors, not limitedly.

Figure 4:
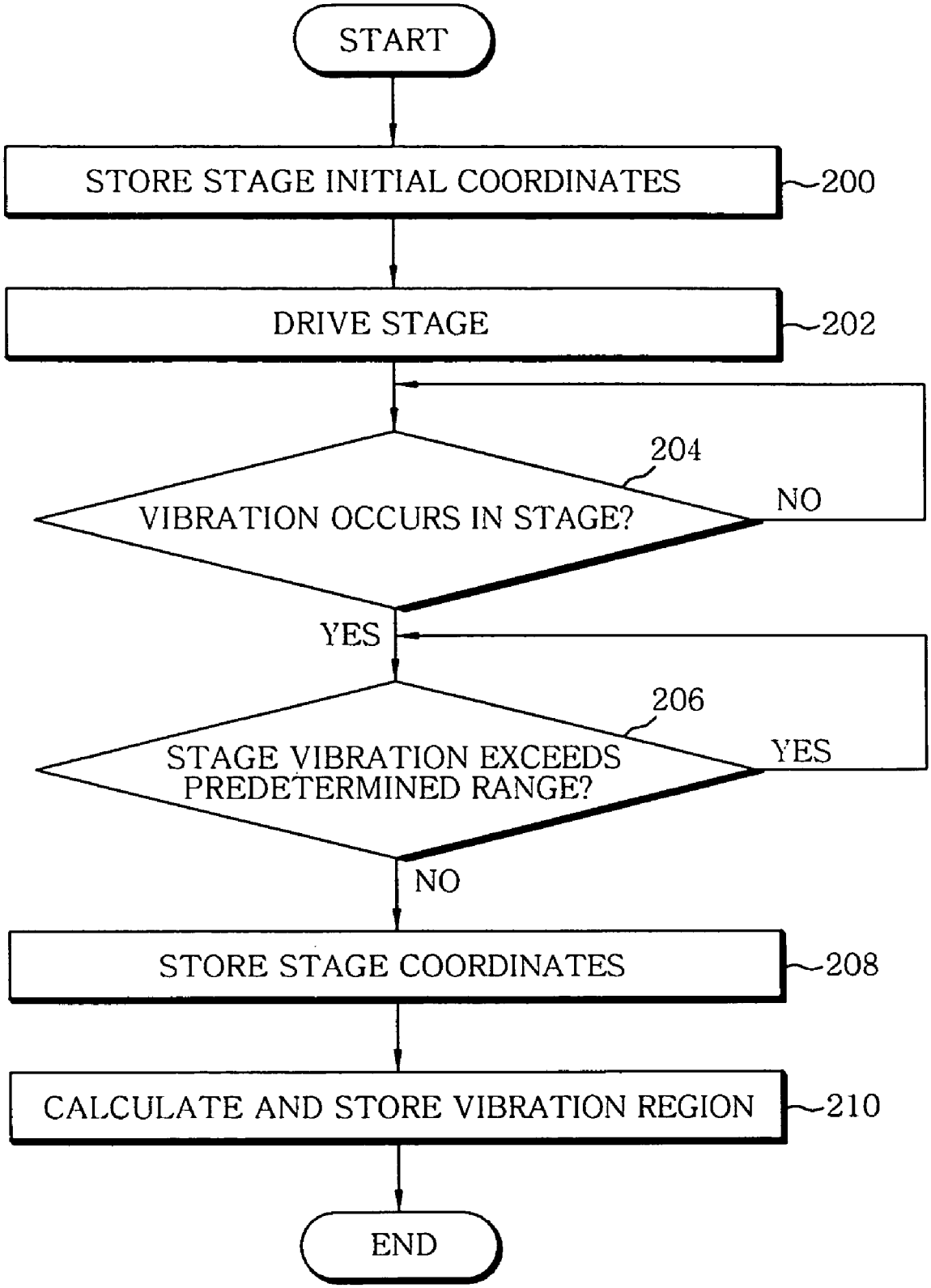
FIG. 4 is a flowchart showing a vibration region detecting method according to a preferred embodiment of the present invention.
Figure 5:
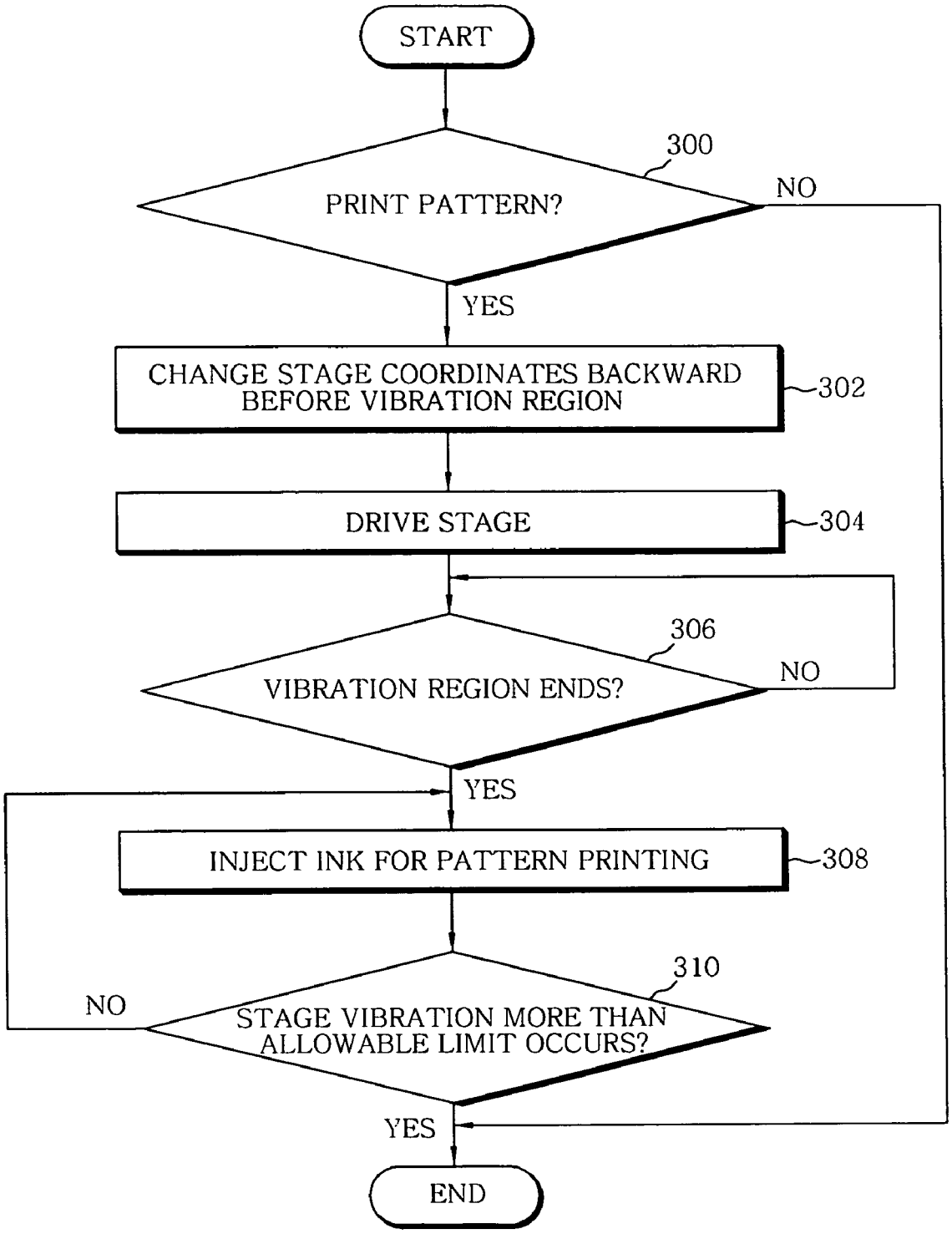
FIG. 5 is a flowchart illustrating an ink injection method according to a preferred embodiment of the present invention.

Now, the operation of the ink injection apparatus configured as above will be explained in detail with reference to FIGS. 4 to 6.

First, a method for detecting an initial vibration region of the stage 106 according to a preferred embodiment of the present invention is explained with reference to the flowchart of FIG. 4.

The controller 100 stores initial coordinates of the stage 106 (Step 200), and then controls the stage driver 104 to move the stage 106 (Step 202). Here, the stage driver 104 starts moving the stage 106 in a predetermined direction under the control of the controller 100. Together with the movement of the stage 106, the controller 100 senses vibration of the stage 106 using the vibration sensor unit 112, and then checks whether the sensed vibration exceeds a predetermined range, for example ±5 um (Steps 204, 206).

If the sensed vibration is within the predetermined range, the controller 100 stores current coordinates of the stage 106 to the memory 102 (Step 208). Here, the current coordinates are obtained while the stage 106 is in a stable status, so hereinafter it is referred to as "stable coordinates".

After that, the controller 100 deducts the initial coordinates from the stable coordinates to calculate a vibration region of the stage 106, and then stores the vibration region to the memory 102 (Step 210). Here, the vibration region may be detected differently depending on the kind of the ink injection apparatus. Also, for stable pattern printing, the vibration may be set as a final vibration region obtained by adding a predetermined value to the detected vibration region.

Now, an ink injection method using the detected vibration region according to a preferred embodiment of the present invention will be explained with reference to the flowchart of FIG. 5.

If a command for printing a pattern is input, the controller 100 deducts coordinates of the stage 106 in a direction opposite to a pattern printing direction as much as the vibration region on the basis of coordinates at which the pattern printing starts (Steps 300, 302).

After that, the controller 100 controls the stage driver 104 so that the stage 106 moves to the changed coordinates (Step 304). Here, the stage driver 104 starts moving the stage 106 in a pattern printing direction after moving the stage 106 to the changed coordinates 106, under the control of the controller 100.

If the stage 106 starts moving, the controller 100 checks whether an actual moving distance obtained by deducting the initially changed coordinates of the stage 106 from current coordinates of the stage 106 is corresponding to the vibration region (Step 306).

If the moving distance of the stage 106 is corresponding to the vibration region, it is determined that the vibration region ends, so the controller 100 controls the head controller 108 to start ink injection for printing a pattern (Step 308).

The head controller 108 controls the head 110 to inject ink under the control of the controller 100, and accordingly the pattern printing starts.

During the pattern printing, the controller 110 checks whether the vibration sensor unit 112 senses a stage vibration exceeding an allowable limit (Step 310). If a stage vibration exceeding the allowable limit is sensed, the pattern printing is intercepted and stopped.

Figure 6:
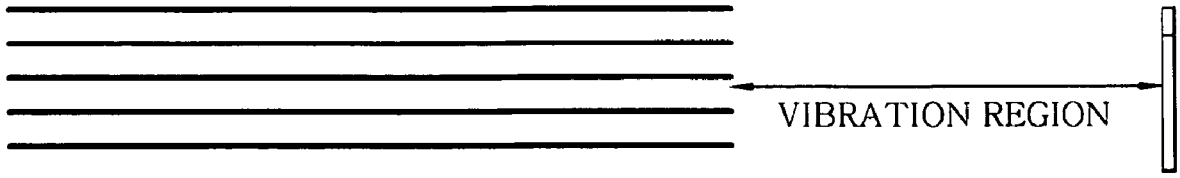
FIG. 6 is a schematic view showing an example of ink injection according to a preferred embodiment of the present invention.

FIG. 6 shows a printed pattern according to the present invention. Referring to FIG. 6, when the stage 106 is moved from the initial coordinates of a pattern to be actually printed in a backward direction as much as the vibration region, the stage 106 is just moving in the vibration region without injecting ink. After that, if the stage 106 reaches an end point of the vibration region, namely the initial coordinates point of the pattern to be actually printed, the stage 106 is controlled to inject ink in correspondence to the pattern to be printed. Accordingly, the present invention may prevent erroneous printing of a pattern caused by vibration of the stage 106.

The embodiments of the present invention also include a computer-readable medium including a program command for executing operations realized by various computers. The computer-readable medium may include program commands, data files, data structures and so on, in single or in combination. The program commands of the medium may be specially designed for the present invention, or designed or configured using program languages well known in the computer software field.

APPLICABILITY TO THE INDUSTRY

As mentioned above, the ink injection apparatus of the present invention detects an initial vibration region of a stage to which a head for injecting ink is mounted, changes stage coordinates to a backward position before the initial vibration region when printing a pattern, and then starts ink injection for the pattern printing if the stage moves as much as the vibration region so that a pattern is not printed erroneously due to initial vibration caused by movement of the stage.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. An ink injection method, comprising:

(a) storing vibration region information of a stage to which a head for injecting ink is mounted;

(b) changing coordinates of the stage by deducting the coordinates as much as the vibration region in a direction opposite to a pattern printing direction on the basis of coordinates at which pattern printing starts;

(c) moving the stage in the pattern printing direction after the stage is moved to the changed coordinates;

(d) deducting the changed coordinates from current coordinates of the stage to calculate a moving distance of the moving stage; and (e) controlling the head to inject ink in correspondence to the pattern in case the moving distance of the stage is corresponding to the vibration region.

2. The ink injection method according to claim 1, wherein the step (a) includes:

storing initial coordinates of the stage;

sensing vibration of the stage while moving the stage in a predetermined direction;

storing current coordinates of the stage in case vibration of the stage is within a predetermined range; and calculating the vibration region of the stage by deducting the initial coordinates from the current coordinates.

3. The ink injection method according to claim 2, wherein the step (a) further includes:

adding a predetermined value to the vibration region of the stage and setting the result value as a final vibration region.

4. The ink injection method according to claim 1, further comprising:

sensing vibration of the stage while ink is injected in correspondence to the pattern; and intercepting the ink injection in case the vibration of the stage exceeds a predetermined limit.

5. An ink injection apparatus, comprising:

a head for injecting ink to print a pattern;

a head controller for controlling the head;

a stage to which the head is mounted;

a stage driver for driving the stage;

a memory for storing vibration region information of the stage; and a controller executing:

deducting coordinates of the stage to a changed coordinates in a direction opposite to a pattern printing direction on the basis of initial coordinates at which pattern printing starts;

controlling the stage driver to move the stage to the changed coordinates and then to move the stage in the pattern printing direction;

calculating a moving distance by deducting current coordinates of the stage from the changed coordinates; and controlling the head controller to inject ink in correspondence to the pattern in case the moving distance of the stage is corresponding to the vibration region.

6. The ink injection apparatus according to claim 5, further comprising a vibration sensor unit for sensing vibration of the stage, wherein the controller executes:

storing initial coordinates of the stage;

sensing vibration of the stage with moving the stage in a predetermined direction;

storing current coordinates of the stage in case the sensed vibration is within a predetermined range; and calculating a vibration region of the stage by deducting the initial coordinates from the current coordinates.

7. The ink injection apparatus according to claim 5, further comprising a vibration sensor unit, wherein, while ink is injected in correspondence to the pattern, the controller intercepts the ink injection in case vibration of the stage exceeds a predetermined limit.

* * * * *